US011404186B1

(12) United States Patent
Chen et al.

(10) Patent No.: US 11,404,186 B1
(45) Date of Patent: Aug. 2, 2022

(54) PTC CIRCUIT PROTECTION DEVICE

(71) Applicant: FUZETEC TECHNOLOGY CO., LTD., New Taipei (TW)

(72) Inventors: Jack Jih-Sang Chen, New Taipei (TW); Chang-Hung Jiang, New Taipei (TW)

(73) Assignee: FUZETEC TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/238,576

(22) Filed: Apr. 23, 2021

(51) Int. Cl.

| | |
|---|---|
| ***H01C 7/02*** | (2006.01) |
| ***H01C 17/28*** | (2006.01) |
| ***H01C 1/148*** | (2006.01) |
| ***H01C 1/14*** | (2006.01) |

(52) U.S. Cl.
CPC ..... *H01C 7/021* (2013.01); *H01C 1/1406* (2013.01); *H01C 1/148* (2013.01); *H01C 17/28* (2013.01)

(58) Field of Classification Search
CPC ..... H01C 7/021; H01C 1/1406; H01C 1/148; H01C 17/28
See application file for complete search history.

(56) References Cited

U.S. PATENT DOCUMENTS

| | | | | |
|---|---|---|---|---|
| 6,285,275 | B1 * | 9/2001 | Chen | H01C 1/1406 338/22 R |
| 8,451,084 | B2 * | 5/2013 | Huang | H01C 1/148 338/22 R |
| 9,000,881 | B2 * | 4/2015 | Chu | H01C 7/02 338/22 R |
| 9,142,949 | B2 * | 9/2015 | Usui | H02H 3/085 |
| 10,453,594 | B1 * | 10/2019 | Tseng | H01C 7/021 |
| 2003/0001717 | A1 * | 1/2003 | Zhang | H01C 7/18 338/22 R |
| 2013/0187748 | A1 * | 7/2013 | Sha | H01C 7/008 338/22 R |
| 2014/0091896 | A1 * | 4/2014 | Wang | H01C 1/08 338/22 R |
| 2019/0139684 | A1 * | 5/2019 | Chen | H01C 1/084 |

* cited by examiner

*Primary Examiner* — Kyung S Lee

(57) ABSTRACT

A PTC circuit protection device includes a PTC polymeric layer; a first electrically conductive layer electrically connected to the PTC polymeric layer; a second electrically conductive layer electrically connected to the PTC polymeric layer; an insulation layer unit disposed on the first and second electrically conductive layers; a first electrode formed on the insulation layer unit and electrically connected to the first electrically conductive layer; and a second electrode formed on the insulation layer unit and electrically connected to the second electrically conductive layer, wherein the first electrode is formed with a first recess.

17 Claims, 4 Drawing Sheets

PTC CIRCUIT PROTECTION DEVICE

FIELD

The disclosure relates to a positive temperature coefficient (PTC) circuit protection device, and more particularly to a PTC circuit protection device formed with a recess.

BACKGROUND

A positive temperature coefficient (PTC) component exhibits a PTC effect that renders the same to be useful as a circuit protection device, such as a resettable fuse. The PTC component includes a PTC polymeric unit and first and second electrodes formed on two opposite surfaces of the PTC polymeric unit. The PTC polymeric unit includes a polymer matrix that contains a crystalline region and a non-crystalline region, and a particulate conductive filler that is dispersed in the non-crystalline region of the polymer matrix and that is formed into a continuous conductive path for electrical conduction between the first and second electrodes. The PTC effect is a phenomenon that occurs when the temperature of the polymer matrix is raised to its melting point, in which crystals in the crystalline region start melting, resulting in generation of a new non-crystalline region. As the new non-crystalline region is increased to an extent to merge into the original non-crystalline region, the conductive path of the particulate conductive filler will become discontinuous and the resistance of the PTC polymer material will be sharply increased, thereby resulting in an electrical disconnection between the first and second electrodes.

Referring to FIG. 1, a conventional surface-mounted PTC circuit protection device 1 includes a PTC unit. 14, a first insulation layer 15, a second insulation layer 16, a first electrode 17 and a second electrode 18. The PTC unit 14 includes a first electrically conductive member 12, a second electrically conductive member 13 and a polymeric layer 11 laminated between the first and second electrically conductive members 12, 13. The polymeric layer 11 exhibits PTC behavior and includes a polymer matrix and a particulate conductive filler dispersed in the polymer matrix. The first insulation layer 15 is disposed on the first electrically conductive member 12, whereas the second insulation layer 16 is disposed on the second electrically conductive member 13. The first electrode 17 is electrically coupled to the first electrically conductive member 12, and is disposed on the first insulation layer 15 and further extends toward the second insulation layer 16. Likewise, the second electrode 18 is electrically coupled to the second electrically conductive member 13, and is disposed on the second insulation layer 16 and further extends toward the first insulation layer 15.

The conventional surface-mounted PTC circuit protection device 1 is usually mounted onto an electronic equipment (e.g., printed circuit board (not shown)) by soldering. However, poor solderability between the surface-mounted PTC circuit protection device 1 and the electronic equipment might occur.

SUMMARY

Therefore, an object of this disclosure is to provide a PTC circuit protection device that can alleviate at least one of the drawbacks of the prior art.

According to this disclosure, the PTC circuit protection device includes:

a PTC polymeric layer;

a first electrically conductive layer that is disposed on and electrically connected to the PTC polymeric layer;

a second electrically conductive layer that is disposed on and electrically connected to the PTC polymeric layer, and that is electrically insulated from the first electrically conductive layer;

an insulation layer unit disposed on the first electrically conductive layer and the second electrically conductive layer;

a first electrode formed on the insulation layer unit, electrically connected to the first electrically conductive layer, and electrically insulated from the second electrically conductive layer; and a second electrode formed on the insulation layer unit, electrically connected to the second electrically conductive layer, and electrically insulated from the first electrically conductive layer and the first electrode, wherein the first electrode is formed with a first recess that, is indented from a surface of the first electrode toward the PTC polymeric layer, and the second electrode is formed with a second recess that is indented from a surface of the second electrode toward the PTC polymeric layer.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
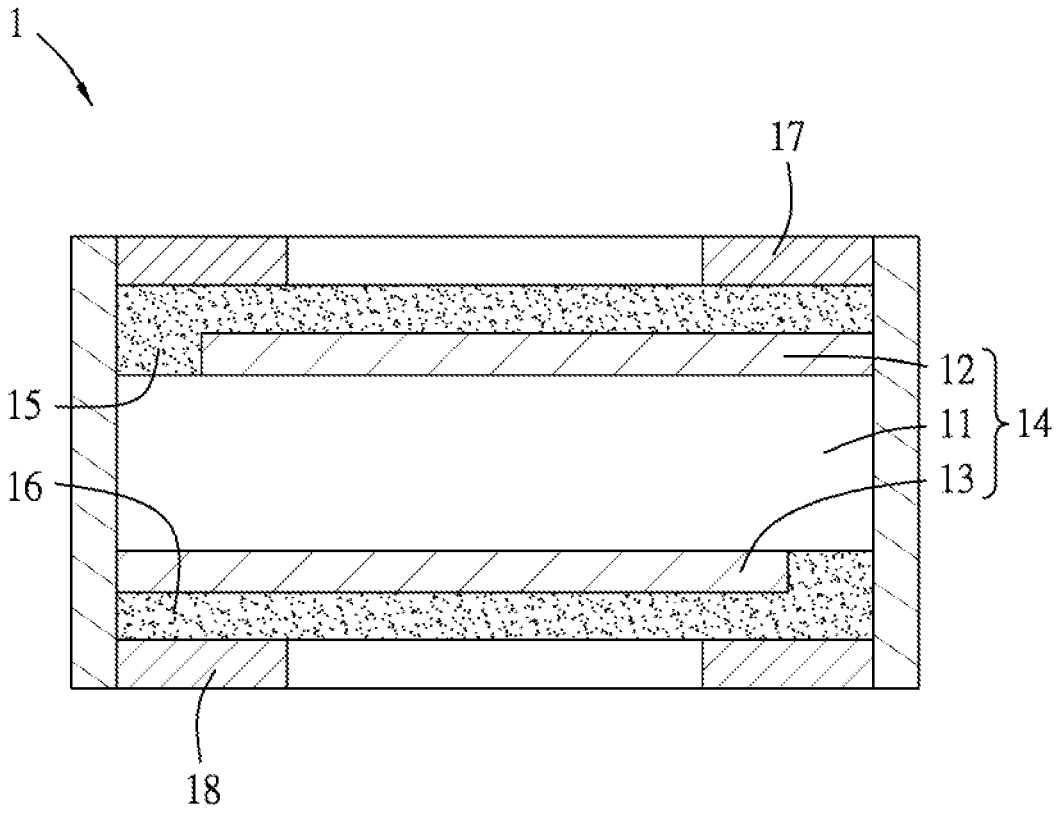
FIG. 1 PRIOR ART
FIG. 1 is a perspective view of a conventional PTC circuit protection device.

Before the disclosure is described in greater detail, it should be noted that where considered appropriate, reference numerals or terminal portions of reference numerals have been repeated among the figures to indicate corresponding or analogous elements, which may optionally have similar characteristics.

In addition, in the description of the disclosure, the terms "up", "down", "upper", "lower" are meant to indicate relative position between the elements of the disclosure, and are not meant to indicate the actual position of each of the elements in actual implementations.

Figure 2:
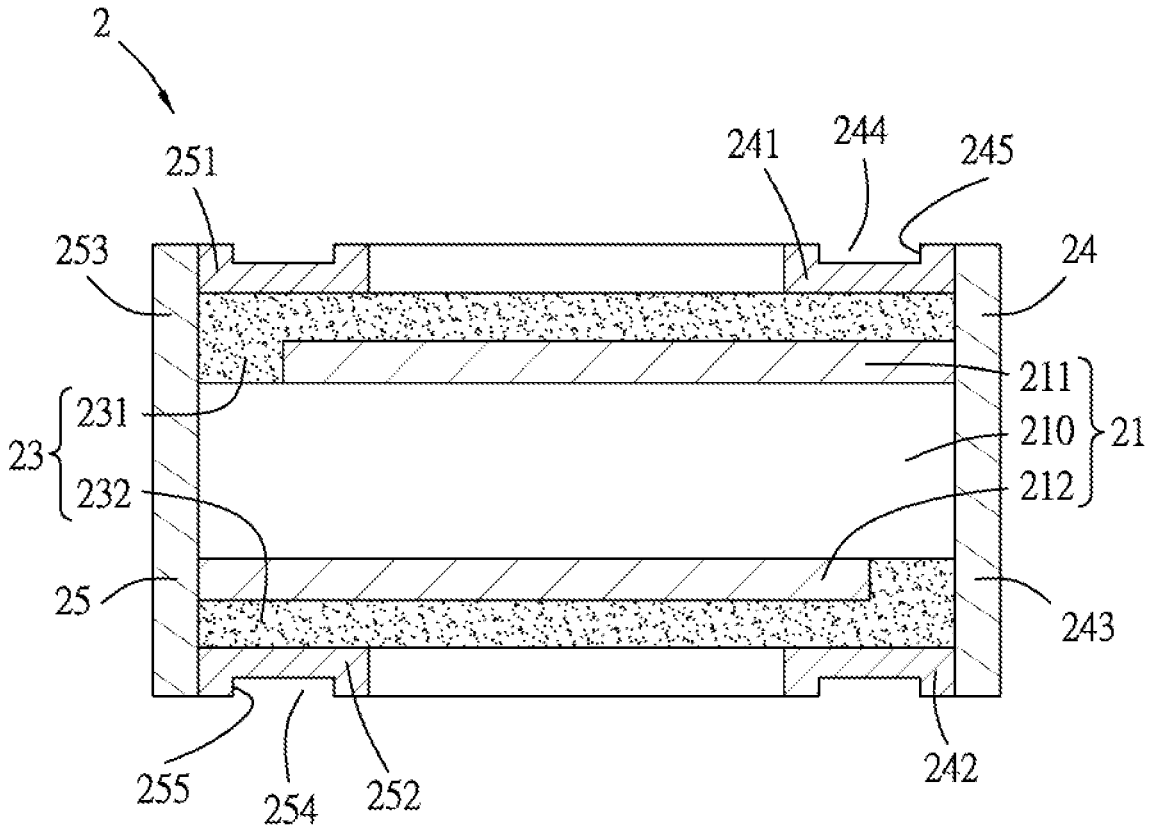
FIG. 2 is a perspective view of a first embodiment of a PTC circuit protection device according to this disclosure.

Referring to FIG. 2, a first embodiment of a PTC circuit protection device 2 according to the present disclosure includes a PTC unit 21, an insulation layer unit 23, a first electrode 24, and a second electrode 25. The PTC unit 21 includes a PTC polymeric layer 210, a first electrically conductive layer 211, and a second electrically conductive layer 212. The first electrically conductive layer 211 is disposed on and is electrically connected to the PTC polymeric layer 210. The second electrically conductive layer 212 is disposed on and is electrically connected to the PTC polymeric layer 210, and is separated from the first electrically conductive layer 211. The insulation layer unit 23 is disposed on the first electrically conductive layer 211 and the second electrically conductive layer 212. The first electrode 24 is formed on the insulation layer unit 23 and is electrically connected to the first electrically conductive layer 211, and is electrically insulated from the second electrically conductive layer 212. The second electrode 25 is formed on the insulation layer unit 23 and is electrically connected to the second electrically conductive layer 212, and is electrically insulated from the first electrically conductive layer 211 and the first electrode 24. The first electrode 24 is formed with a first recess 244 that is indented from a surface of the first electrode 24 toward the PTC polymeric layer 210. In certain embodiments, the second electrode 25 is formed with a second recess 254 that is indented from a surface of the second electrode 25 toward the PTC polymeric layer 210.

The first electrode 24 has a first recess-defining wall 245 that defines the first recess 244, and the second electrode 25 has a second recess-defining wall 255 that defines the second recess 254. In certain embodiments, the first recess-defining wall 245 has a percentage of a surface area which is greater than or equal to 10% based on a surface area of the first electrode 24. In certain embodiments, the second recess-defining wall 255 has a percentage of a surface area which is greater than or equal to 10% based on a surface area of the second electrode 25. It should be noted that, the aforementioned surface area of each of the first and second electrodes 24, 25 is indicated as the surface area of a portion of each of the first and second electrodes 24, 25 that is not in contact with the PTC unit 21 or the insulation layer unit 23.

In certain embodiments, the percentage of the surface area of each of the first recess 244 and the second recess 254 ranges from 10% to 80%.

In certain embodiments, the percentage of the surface area of each of the first recess 244 and the second recess 254 ranges from 25% to 75%.

In this embodiment, the PTC polymeric layer 210 includes an upper surface, a lower surface opposite to the upper surface, and a surrounding surface interconnecting the upper surface and the lower surface. In this embodiment, the first electrically conductive layer 211 is disposed on the upper surface, and the second electrically conductive layer 212 is disposed on the lower surface. The insulation layer unit 23 includes a first insulation layer 231 disposed on the first electrically conductive layer 211 and a second insulation layer 232 disposed on the second electrically conductive layer 212. The first electrode 24 includes an upper first electrode portion 241 that is disposed on the first insulation layer 231, a lower first electrode portion 242 that is disposed on the second insulation layer 232, and a first electrode connecting portion 243 that is formed on the surrounding surface of the PTC polymeric layer 210 and that interconnects the upper first electrode portion 241 and the lower first electrode portion 242. The second electrode 25 includes an upper second electrode portion 251 that is disposed on the first insulation layer 231, a lower second electrode portion 252 that is disposed on the second insulation layer 232, and a second electrode connecting portion 253 that is formed on the surrounding surface of the PTC polymeric layer 201 and that interconnects the upper second electrode portion 251 and the lower second electrode portion 252.

In certain embodiments, the first recess 244 of the first electrode 24 is formed on one of the upper first electrode portion 241 and the lower first electrode portion 242. In certain embodiments, the first electrode 24 has two of the first recesses 244 that are respectively formed on the upper first electrode portion 241 and the lower first electrode portion 242.

In certain embodiments, the second recess 254 of the second electrode 25 is formed on one of the upper second electrode portion 251 and the lower second electrode portion 252. In certain embodiments, the second electrode has two of the second recesses 254 that are respectively formed on the upper second electrode portion 251 and the lower second electrode portion 252.

Figure 3:
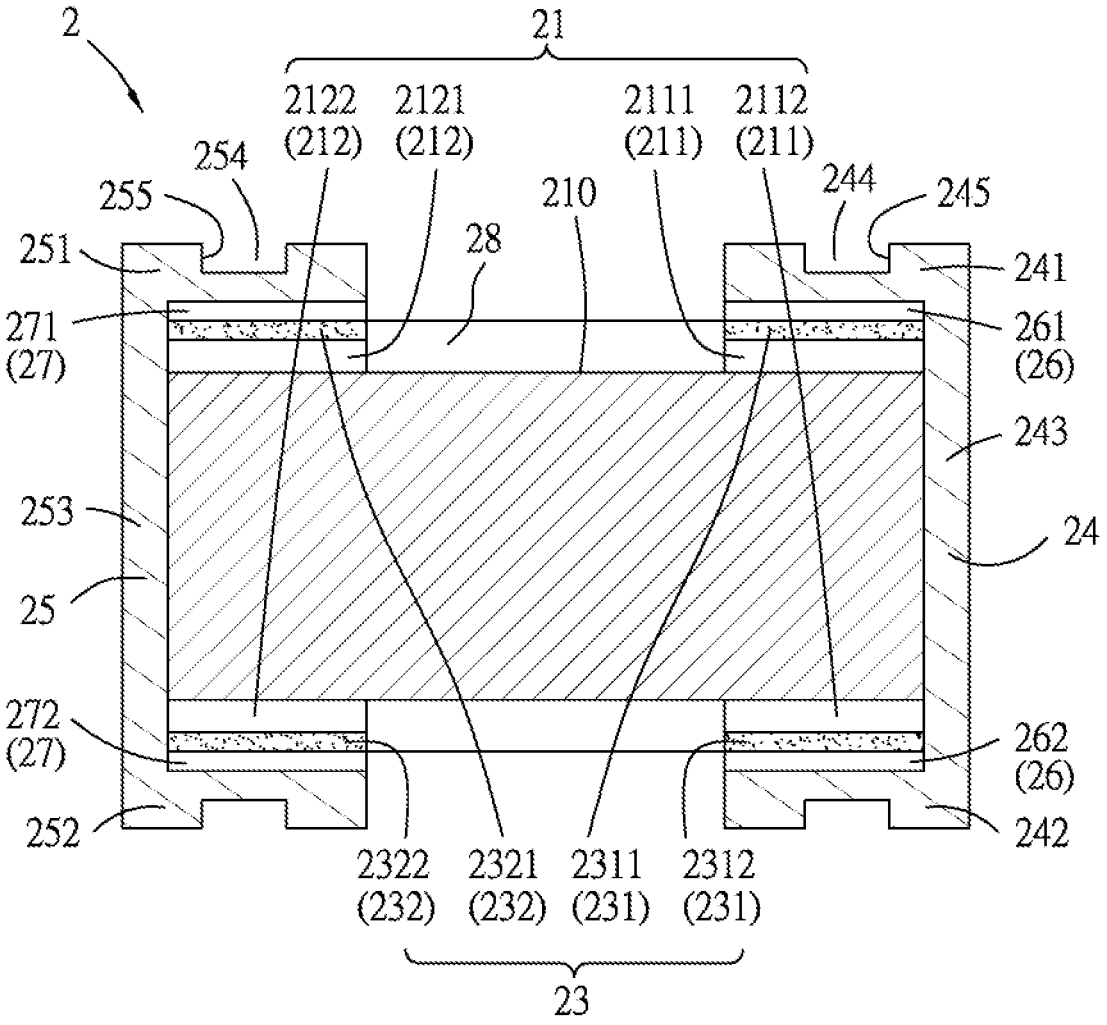
FIG. 3 is a perspective view of a second embodiment of the PTC circuit protection device according to this disclosure.
Figure 4:
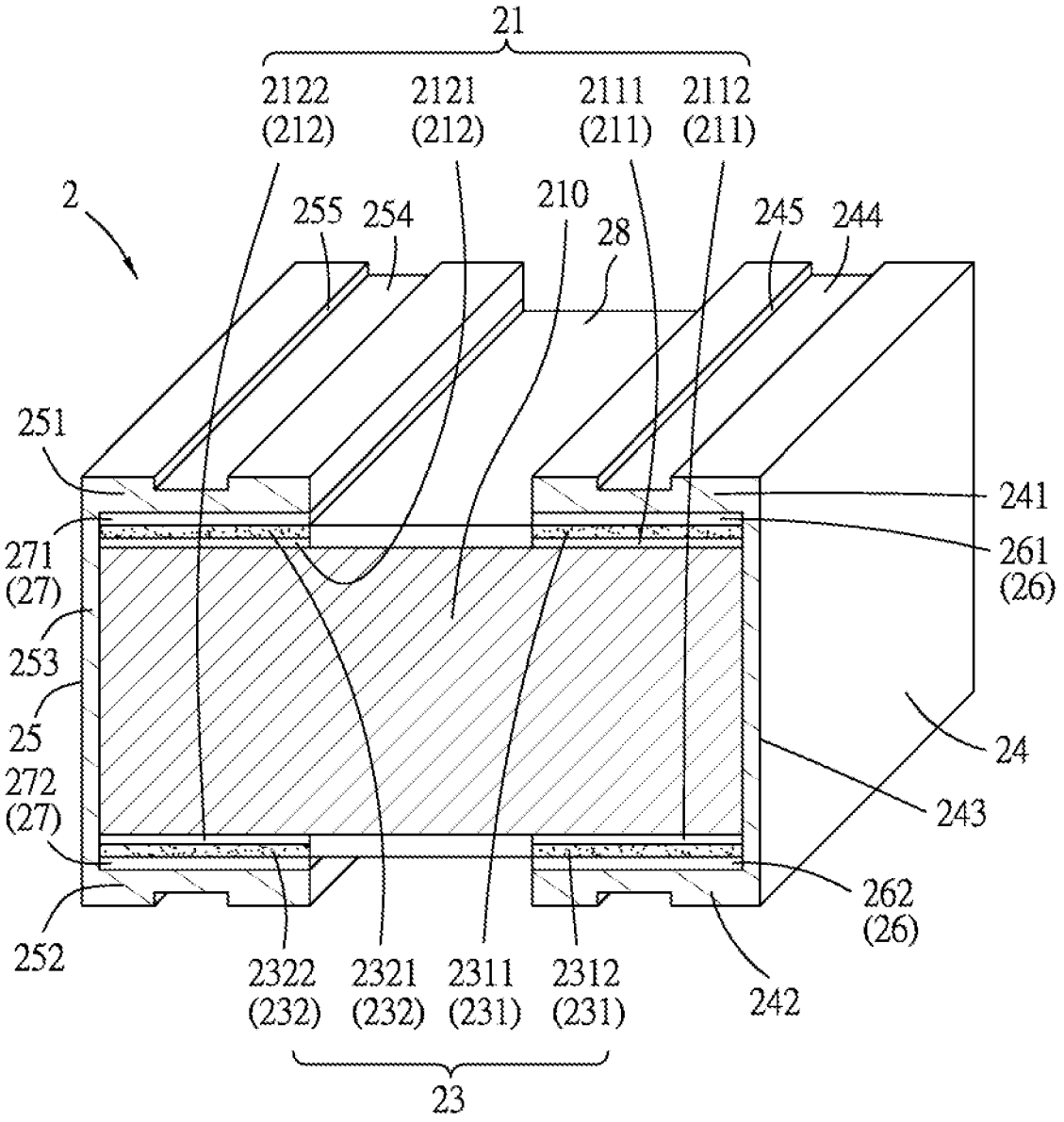
FIG. 4 is a schematic view of the second embodiment of the PTC circuit protection device.

Referring to FIG. 3 and FIG. 4, a second embodiment of the PTC circuit protection device is similar to that of the first embodiment, except with differences described as follows.

Referring to FIG. 3 and FIG. 4, the PTC polymeric layer 210 includes an upper surface, a lower surface opposite to the upper surface, and a surrounding surface interconnecting the upper surface and the lower surface. In this embodiment, the first electrically conductive layer 211 includes an upper first electrically conductive portion 2111 disposed on the upper surface, and a lower first electrically conductive portion 2112 disposed on the lower surface. The second electrically conductive layer 212 includes an upper second electrically conductive portion 2121 disposed on the upper surface, and a lower second electrically conductive portion 2122 disposed on the lower surface. The insulation layer unit 23 includes a first insulation layer 231 and a second insulation layer 232 respectively disposed on the first and second electrically conductive layers 211, 212. The first insulation layer 231 includes an upper first insulation portion 2311 disposed on the upper first electrically conductive portion 2111, and a lower first insulation portion 2312 disposed on the lower first electrically conductive portion 2112. The second insulation layer 232 includes an upper second insulation portion 2321 disposed on the upper second electrically conductive portion 2121, and a lower second insulation portion 2322 disposed on the lower second electrically conductive portion 2122. The first electrode 24 includes an upper first electrode portion 241 disposed on the upper first insulation portion 2311, a lower first electrode portion 242 disposed on the lower first insulation portion 2312, and a first electrode connecting portion 243 that is formed on the surrounding surface of the PTC polymeric layer 210 and that interconnects the upper first electrode portion 241 and the lower first electrode portion 242. The second electrode 25 includes an upper second electrode portion 251 disposed on the upper second insulation portion 2321, a lower second electrode portion 252 disposed on the lower second insulation portion 2322, and a second electrode connecting portion 253 that is formed on the surrounding surface of the PTC polymeric layer 210 and that interconnects the upper second electrode portion 251 and the lower second electrode portion 252.

In certain embodiments, the first recess 244 of the first electrode 24 is formed on one of the upper first electrode portion 241 and the lower first electrode portion 242. In certain embodiments, the first electrode 24 has two of the first recesses 244 that are respectively formed on the upper first electrode portion 241 and the lower first electrode portion 242.

In certain embodiments, the second recess 254 of the second electrode 25 is formed on one of the upper second electrode portion 251 and the lower second electrode portion 252. In certain embodiments, the second electrode 25 has two of the second recesses 254 that are respectively formed on the upper second electrode portion 251 and the lower second electrode portion 252.

In certain embodiments, the upper first electrode portion 241 has a first recess-defining wall 245 that defines the first recess 244, and the upper second electrode portion 251 has a second recess-defining wall 255 that defines the second recess 254, the first and second recess-defining walls 245, 255 having a percentage of a surface area being greater than or equal to 10% based on a surface area of upper surfaces of the upper first and upper second electrode portions 241, 251.

In certain embodiments, based on the surface area of the upper surfaces of the upper first and upper second electrode portions 241, 251, the percentage of the surface area of the first and second recess-defining walls 245, 255 ranges from 10% to 80%, or from 25% to 75%.

In certain embodiments, the percentage of the surface area of the first recess 244 based on the surface area of the upper surface of the upper first electrode portion 241 is greater than or equal to 10%, or, in some embodiments, ranges from 10% to 80%, or from 25% to 75%. In certain embodiments, the percentage of the surface area of the second recess 254 based on the surface area of the upper surface of the upper second electrode portion 251 is greater than or equal to 10%, or, in some embodiments, ranges from 10% to 80%, or from 25% to 75%. In this embodiment, an insulation spacer 28 is disposed between the upper first electrically conductive portion 2111 and the upper second electrically conductive portion 2121. The insulation spacer 28 may also be disposed between the lower first electrically conductive portion 2112 and the lower second electrically conductive portion 2122.

In certain embodiments, the PTC circuit protection device 2 further includes a third electrically conductive layer 26 and a fourth electrically conductive layer 27. The third electrically conductive layer 26 includes an upper third electrically conductive portion 261 disposed between the upper first insulation portion 2311 and the upper first electrode portion 241, and a lower third electrically conductive portion 262 disposed between the lower first insulation portion 2312 and the lower first electrode portion 242. The fourth electrically conductive layer 27 includes an upper fourth electrically conductive portion 271 disposed between the upper second insulation portion 2321 and the upper second electrode portion 251, and a lower fourth electrically conductive portion 272 disposed between the lower second insulation portion 2322 and the lower second electrode portion 252.

In some embodiments, each of the first and second electrically conductive layers 211, 212 may be made of a metal material, such as metal foil, plated foil (e.g., nickel-plated copper foil), etc.

In certain embodiments, the insulation layer unit 23 is made from epoxy resin.

In this disclosure, the PTC polymeric layer 210 includes a polymer matrix and a particulate conductive filler dispersed in the polymer matrix. The polymer matrix may be made from a polymer composition that contains a non-grafted olefin-based polymer (e.g., high density polyethylene, HDPE). In certain embodiments, the polymer composition of the polymer matrix further includes a grafted olefin-based polymer. In certain embodiments, the grafted olefin-based polymer includes a carboxylic acid anhydride-grafted olefin-based polymer. The carboxylic acid anhydride-grafted olefin-based polymer may be carboxylic acid anhydride-grafted high density polyethylene. In this embodiment, the carboxylic acid anhydride-grafted olefin-based polymer is maleic anhydride-grafted HDPE.

In this disclosure, the particulate conductive filler may be made from carbon black, metal, an electrically conductive ceramic material, and combinations thereof.

Examples of the particulate conductive filler include titanium carbide, zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, tungsten disilicide, gold, silver, copper, aluminum, nickel, nickel-metallized glass beads, nickel-metallized graphite, Ti—Ta solid solution, W—Ti—Ta—Cr solid solution, W—Ta solid solution, W—Ti—Ta—Nb solid solution, W—Ti—Ta solid solution, W—Ti solid solution, Ta—Nb solid solution, and combinations thereof.

In some embodiments, the polymer matrix may be present in an amount ranging from 5 wt % to 50 wt % based on the weight of the PTC polymeric layer 210, and the particulate conductive filler may be present in an amount ranging from 50 wt % to 95 wt % based on the weight of the PTC polymeric layer 210.

A method of manufacturing the PTC circuit protection device 2 is provided, which includes the following steps: a) providing a PTC polymeric layer 210; b) forming a first electrically conductive layer 211 on the PTC polymeric layer 210, the first electrically conductive layer 211 being electrically connected to the PTC polymeric layer 210; c) forming a second electrically conductive layer 212 on the PTC polymeric layer 210, the second electrically conductive layer 212 being electrically connected to the PTC polymeric layer 210 and being separated from the first electrically conductive layer 211; d) forming an insulation layer unit 23 on the first and second electrically conductive layers 211, 212; e) hot pressing the PTC polymeric layer 210, the first electrically conductive layer 211, the second electrically conductive layer 212, and the insulation layer unit 23 to form a stack; f) forming a first electrode 24 on the stack, the first electrode 24 being electrically connected to the first electrically conductive layer 211; g) forming a second electrode 25 on the stack, the second electrode 25 being electrically connected to the second electrically conductive layer 212 and being electrically insulated from the first electrode 24; and h) forming a first recess 244 on the first electrode 24, the first recess 244 being indented from a surface of the first electrode 24 toward the PTC polymeric layer 210. In certain embodiments, the method further includes the step of i) forming a second recess 254 on the second electrode 25, the second recess 254 being indented from a surface of the second electrode 25 toward the PTC polymeric layer 210.

Examples and comparative examples of the disclosure will be described hereinafter. It is to be understood that these examples and comparative examples are exemplary and explanatory and should not be construed as a limitation to the disclosure.

EXAMPLE

Example 1 (E1)

First, 10.5 grams of HDPE (purchased from *Formosa* plastic Corp., catalog no.: HDPE 9002) serving as the non-grafted olefin-based polymer, 10.5 grams of maleic anhydride-grafted HDPE (purchased from Dupont, catalog no.: MB100D) serving as the carboxylic acid anhydride-grafted olefin-based polymer, and 29 grams of carbon black powder (catalog no.: Raven 430UB, commercially available from Columbian Chemicals Company) serving as the particulate conductive filler were compounded in a Brabender mixer so as to obtain a compounded mixture. The compounding temperature was 200° C., the stirring rate of the mixer was 30 rpm, and the compounding time was 10 minutes. The compounded mixture was placed in a mold, and was hot pressed at 200° C. under a pressure of 80 kg/cm$^2$ for 4 minutes to form a PTC polymeric layer.

The PTC polymeric layer was removed from the mold, and then the PTC polymeric layer was sandwiched between upper and lower electrically conductive films of nickel-plated copper foil. The upper electrically conductive film was etched to form first and second portions that are separated from each other and that are respectively formed as an upper first electrically conductive portion and an upper second electrically conductive portion. Similarly, the lower electrically conductive film was etched to form first and second portions that are separated from each other and that are respectively formed as a lower first electrically conductive portion and a lower second electrically conductive portion. The upper first electrically conductive portion and the lower first electrically conductive portion are cooperatively referred to as the first electrically conductive layer 211 as shown in FIG. 3 and FIG. 4. The upper second electrically conductive portion and the lower second electrically conductive portion are cooperatively referred to as the second electrically conductive layer 212 as shown in FIG. 3 and FIG. 4. A stack including the first and second electrically conductive layers and the PTC polymeric layer was thus obtained. The stack was then hot pressed at 200° C. under a pressure of 80 kg/cm$^2$ for 4 minutes to form a PTC unit having a thickness of 0.32 mm.

The PTC unit was then irradiated by a cobalt-60 gamma ray for a total radiation dose of 15 Mrad.

Next, epoxy resin layers were disposed on the first and second electrically conductive layers and the exposed opposite surfaces of the PTC polymeric layer, followed by hot pressing so as to form the first and second insulation layers on the first and second electrically conductive layers, and form the insulation spacers between the upper first and upper second electrically conductive portions and between the lower first and lower second electrically conductive portions, respectively (see FIG. 3 and FIG. 4).

Third and fourth electrically conductive layers were respectively formed on the first and second insulation layers, and a laminate was thus obtained. The third and fourth electrically conductive layers are formed using a procedure the same as that of forming the first and second electrically conductive layers. First and second electrodes were respectively plated on the third and fourth electrically conductive layers and a side surface of the laminate so that each of the first and second electrodes was formed on and extended between the third and fourth electrically conductive layers. The first electrode includes an upper first electrode portion, a lower first electrode portion, and a first electrode connecting portion. The second electrode includes an upper second electrode portion, a lower second electrode portion, and a second electrode connecting portion. A first recess and a second recess were formed on the upper first electrode portion and the upper second electrode portion, respectively, using a digital engraving machine (purchased from Shanghai Yi Diao, catalog no.: YD3040G). The first and second recesses were respectively defined by first and second recess-defining walls. The first recess-defining wall of the first electrode has a percentage of a surface area which is 10% based on a surface area of an upper surface of the upper first electrode portion, and the second recess-defining wall of the second first electrode has a percentage of a surface area which is 10% based on a surface area of an upper surface of the upper second electrode portion. A PTC circuit protection device was thus obtained.

Example 2 to Example 7 (E2 to E7)

The PTC circuit protection devices of E2 to E7 were similar to that of E1, except for the percentage of the surface area of each of the first and second recess-defining walls (see Table 1).

Comparative Example 1 (CE1)

The PTC circuit protection device of CE1 was similar to that of E1, except that no recesses were formed on the first and second electrodes (see Table 1).

TABLE 1

| | Percentage of surface area of the recess-defining walls based on the surface area of the upper surfaces of the upper first and upper second electrode portions (%) |
|---|---|
| E1 | 10 |
| E2 | 25 |
| E3 | 50 |
| E4 | 75 |
| E5 | 80 |
| E6 | 5 |
| E7 | 90 |
| CE1 | 0 |

Performance Test

<Solderability Test>

A Sn-based solder paste was applied to the upper surfaces of the upper first and upper second electrode portions of each of the PTC circuit protection devices of E1 to E7 and CE1. Thereafter, each of the PTC circuit protection devices of E1 to E7 and CE1 was attached to a printed circuit board (PCB) through the Sn-based solder paste to obtain a test sample. Next, the test sample was placed in a reflow oven to undergo reflow soldering. The peak temperature of the reflow oven was set at 285° C., so that the air temperature in the reflow oven reached 260° C. The air temperature in the reflow oven was kept at 260° C. for 20 seconds. The reflow soldering procedure was carried out for 4 minutes. Next, solderability of the Sn-based solder paste to each of the upper surfaces of the upper first and upper second electrode portions was observed. A successful soldering is defined by more than 90% of a surface area of each of the upper surfaces of the upper first and upper second electrode portions being covered with the Sn-based solder paste. The percentage of successful soldering of the test samples was shown in Table 2.

TABLE 2

| | Total amount of test sample (pieces) | Amount of test sample with successful soldering (pieces) | Percentage of successful soldering (%) |
|---|---|---|---|
| E1 | 1000 | 995 | 99.5 |
| E2 | 1000 | 1000 | 100.0 |
| E3 | 1000 | 1000 | 100.0 |
| E4 | 1000 | 1000 | 100.0 |

TABLE 2-continued

| | Total amount of test sample (pieces) | Amount of test sample with successful soldering (pieces) | Percentage of successful soldering (%) |
|---|---|---|---|
| E5 | 1000 | 983 | 98.3 |
| E6 | 1000 | 945 | 94.5 |
| E7 | 1000 | 948 | 94.8 |
| CE1 | 1000 | 913 | 91.3 |

Results in Table 2 show that the PTC circuit protection devices of E1 to E7, especially those of E1 to E5 (i.e., test samples with a percentage of recess surface area ranging from 10% to 80%), have excellent solderability to PCB compared to the PTC circuit protection device of CE1 (i.e., test samples without recesses). In particular, when the percentage of the recess surface area of the test samples ranges from 25% to 75%, the percentage of successful soldering reaches 100%.

In view of the aforesaid, by forming the recesses on the electrodes and controlling the recess surface area based on the corresponding electrode surface area, the PTC circuit protection device of this disclosure achieves superior bonding strength with the PCB.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A PTC circuit protection device, comprising:

a PTC polymeric layer;

a first electrically conductive layer that is disposed on and electrically connected to said PTC polymeric layer;

a second electrically conductive layer that is disposed on and electrically connected to said PTC polymeric layer, and that is separated from said first electrically conductive layer;

an insulation layer unit that is disposed on said first electrically conductive layer and said second electrically conductive layer;

a first electrode that is formed on said insulation layer unit, that is electrically connected to said first electrically conductive layer, and that is electrically insulated from said second electrically conductive layer; and a second electrode that is formed on said insulation layer unit, that is electrically connected to said second electrically conductive layer, and that is electrically insulated from said first electrically conductive layer and said first electrode, wherein said first electrode is formed with a first recess that is indented from a surface of said first electrode toward said PTC polymeric layer, said PTC polymeric laver has an upper surface, a lower surface opposite to said upper surface, and a surrounding surface interconnecting said upper surface and said lower surface, said first electrically conductive layer includes an upper first electrically conductive portion disposed on said upper surface, and a lower first electrically conductive portion disposed on said lower surface, said second electrically conductive layer includes an upper second electrically conductive portion disposed on said upper surface, and a lower second electrically conductive portion disposed on said lower surface, said insulation layer unit includes a first insulation layer and a second insulation layer respectively disposed on said first electrically conductive layer and said second electrically conductive layer, said first insulation layer including an upper first insulation portion disposed on said upper first electrically conductive portion, and a lower first insulation portion disposed on said lower first electrically conductive portion, said second insulation layer including an upper second insulation portion disposed on said upper second electrically conductive portion, and a lower second insulation portion disposed on said lower second electrically conductive portion, said first electrode includes an upper first electrode portion disposed on said upper first insulation portion, a lower first electrode portion disposed on said lower first insulation portion, and a first electrode connecting portion formed on said surrounding surface of said PTC polymeric layer and interconnecting said upper first electrode portion and said lower first electrode portion, and said second electrode includes an upper second electrode portion disposed on said upper second insulation portion, a lower second electrode portion disposed on said lower second insulation portion, and a second electrode connecting portion formed on said surrounding surface of said PTC Polymeric layer and interconnecting said upper second electrode portion and said lower second electrode portion.

2. The PTC circuit protection device as claimed in claim 1, wherein said second electrode is formed with a second recess that is indented from a surface of said second electrode toward said PTC polymeric layer.

3. The PTC circuit protection device as claimed in claim 2, wherein said first electrode has a first recess-defining wall that defines said first recess, and said second electrode has a second recess-defining wall that defines said second recess, said first and second recess-defining walls having a percentage of a surface area being greater than or equal to 10% based on a surface area of said first and second electrodes.

4. The PTC circuit protection device as claimed in claim 1, wherein said first recess of said first electrode is formed on one of said upper first electrode portion and said lower first electrode portion.

5. The PTC circuit protection device as claimed in claim 1, wherein said first electrode is formed with two of said first recesses which are respectively formed on said upper first electrode portion and said lower first electrode portion.

6. The PTC circuit protection device as claimed in claim 5, wherein said second electrode is formed with at least one of a second recess which is formed on one of said upper second electrode portion and said lower second electrode portion.

7. The PTC circuit protection device as claimed in claim 6, wherein said upper first electrode portion has a first recess-defining wall that defines said first recess, and said upper second electrode portion has a second recess-defining wall that defines said second recess, said first and second recess-defining walls having a percentage of a surface area being greater than or equal to 10% based on a surface area of upper surfaces of said upper first and upper second electrode portions.

8. The PTC circuit protection device as claimed in claim 7, wherein the percentage of the surface area of said first and second recess-defining walls ranges from 10% to 80% based on the surface area of said upper surfaces of said upper first and upper second electrode portions.

9. The PTC circuit protection device as claimed in claim 8, wherein the percentage of the surface area of first and second recess-defining walls ranges from 25% to 75% based on the surface area of said upper surfaces of said upper first and upper second electrode portions.

10. The PTC circuit protection device as claimed in claim 1, further comprising an insulation spacer disposed between said upper first electrically conductive portion and said upper second electrically conductive portion.

11. The PTC circuit protection device as claimed in claim 1, further comprising a third electrically conductive layer and a fourth electrically conductive layer, wherein said third electrically conductive layer includes an upper third electrically conductive portion disposed between said upper first insulation portion and said upper first electrode portion, and a lower third electrically conductive portion disposed between said lower first insulation portion and said lower first electrode portion, and said fourth electrically conductive layer includes an upper fourth electrically conductive portion disposed between said upper second insulation portion and said upper second electrode portion, and a lower fourth electrically conductive portion disposed between said lower second insulation portion and said lower second electrode portion.

12. The PTC circuit protection device as claimed in claim 1, wherein each of said first electrically conductive layer and said second electrically conductive layer is nickel-plated copper foil.

13. The PTC circuit protection device as claimed in claim 1, wherein said insulation layer unit is made from epoxy resin.

14. The PTC circuit protection device as claimed in claim 1, wherein said PTC polymeric layer includes a polymer matrix and a particulate conductive filler dispersed in said polymer matrix, said polymer matrix including a non-grafted olefin-based polymer.

15. The PTC circuit protection device as claimed in claim 14, wherein said polymer matrix further includes a carboxylic acid anhydride-grafted olefin-based polymer.

16. The PTC circuit protection device as claimed in claim 14, wherein said particulate conductive filler is selected from the group consisting of carbon black, metal, an electrically conductive ceramic material, and combinations thereof.

17. The PTC circuit protection device as claimed in claim 2, wherein said second recess of said second electrode is formed on one of said upper second electrode portion and said lower second electrode portion.

* * * * *